US011128964B2

(12) United States Patent
Weibel et al.

(10) Patent No.: US 11,128,964 B2
(45) Date of Patent: Sep. 21, 2021

(54) FILTER FOR A MICROPHONE SYSTEM, A MICROPHONE SYSTEM, A MINIATURE ELECTRONIC DEVICE AND A METHOD OF EQUIPPING A PRINTED CIRCUIT BOARD

(71) Applicant: Sonova AG, Stafa (CH)

(72) Inventors: Manuel Weibel, Erlenbach (CH); Paul Portmann, Lachen (CH); Axel Schlesinger, Stafa (CH)

(73) Assignee: SONOVA AG, Stäfa (CH)

( * ) Notice: Subject to any disclaimer, the term of this patent is extended or adjusted under 35 U.S.C. 154(b) by 0 days.

(21) Appl. No.: 16/609,810

(22) PCT Filed: May 5, 2017

(86) PCT No.: PCT/EP2017/060737
§ 371 (c)(1),
(2) Date: Oct. 31, 2019

(87) PCT Pub. No.: WO2018/202309
PCT Pub. Date: Nov. 8, 2018

(65) Prior Publication Data

US 2020/0059739 A1 Feb. 20, 2020

(51) Int. Cl.
*H04R 25/00* (2006.01)
*H04R 1/04* (2006.01)

(52) U.S. Cl.
CPC ..... *H04R 25/505* (2013.01); *H04R 1/04* (2013.01); *H04R 25/604* (2013.01)

(58) Field of Classification Search
CPC ..... H04R 25/505; H04R 1/04; H04R 25/604
USPC ..... 381/320
See application file for complete search history.

(56) References Cited

U.S. PATENT DOCUMENTS

| | | | |
|---|---|---|---|
| 2012/0025335 | A1 | 2/2012 | Leclair |
| 2013/0129136 | A1 | 5/2013 | Harney et al. |

FOREIGN PATENT DOCUMENTS

| | | | |
|---|---|---|---|
| CN | 101785326 | A | 7/2010 |
| CN | 102642802 | A | 8/2012 |
| KR | 101 045 518 | B1 | 6/2011 |
| WO | 2007/052866 | A1 | 5/2007 |
| WO | 2008/119056 | A1 | 10/2008 |

OTHER PUBLICATIONS

International Search Report for PCT/EP2017/060737 dated Jun. 11, 2017.
Written Opinion for PCT/EP2017/060737 dated Jun. 11, 2017.
First Office Action and Search Report for corresponding Chinese application No. 201780090285.4 dated Oct. 12, 2020.
Office Action for corresponding European application No. 17 723 050.5 dated Feb. 15, 2021.

*Primary Examiner* — Sean H Nguyen
(74) *Attorney, Agent, or Firm* — Pearne & Gordon LLP

(57) ABSTRACT

A filter for a microphone system of a miniature electronic device. The filter includes a sound inlet and a sound outlet, wherein the filter is adapted to be mounted on a surface of a printed circuit board.

21 Claims, 2 Drawing Sheets

FILTER FOR A MICROPHONE SYSTEM, A MICROPHONE SYSTEM, A MINIATURE ELECTRONIC DEVICE AND A METHOD OF EQUIPPING A PRINTED CIRCUIT BOARD

TECHNICAL FIELD

The present invention is related to a filter for a microphone system, a microphone system, a miniature electronic device and a method of equipping a printed circuit board.

BACKGROUND OF THE INVENTION

Hearing devices are typically used to improve the hearing capability or communication capability of a user. A hearing device may pick up the surrounding sound with a microphone of the hearing device, processing the microphone signal thereby taking into account the hearing preferences of the user of the hearing device and providing the processed sound signal into a hearing canal of the user via a miniature loudspeaker, commonly referred to as a receiver. A hearing device may also receive sound from an alternative input such as an induction coil or a wireless interface.

Hearing devices are known comprising microphones, wherein the microphones are protected at the acoustic input with two netlike, acoustically transparent, acoustic input filters. Therefore, an acoustical volume inside the hearing device in front of the microphone is required. This can lead to a complex mechanical solution with losses in sensitivity and change in frequency response and phase of the sound passing to the microphone.

Commonly known hearing devices can be equipped with Micro-Electro-Mechanical System (MEMS) microphones. Disadvantages of MEMS-microphones can comprise a non-linear frequency response and high sensitivity against ultra-sonic noise. The MEMS microphones can be mounted on the printed circuit board by surface mount, or rather automated pick and place process, and do not grant same freedom as e.g. in hand soldered electret microphones with spouts and tubings.

The output of the microphone can be coupled to an electrical low pass filter (LPF) which can reduce non-linearity up to 10 kHz. In an example, an R-C filter is used. This R-C filter can cause a higher total harmonic distortion (THD), phase distortion, higher output impedance, less sensitivity and higher power consumption.

In case of the low pass filter is coupled to the output of the MEMS-microphone, the problem of high sensitivity against ultra-sonic noise still remains.

It is therefore an object of the present invention to provide a filter for a microphone system of a miniature electronic device, which filter solves the problems known in the art.

SUMMARY OF THE INVENTION

It is pointed out that the term 'hearing device' must not only be understood as a device that is used to improve the hearing of hearing impaired patients, but also as a communication device to improve communication between individuals. In addition, the term 'hearing device' comprise hearing device types currently available, as for example behind the ear (BTE), in the ear (ITE), in the canal (ITC) and completely in the canal (CIC) hearing devices. Furthermore, hearing devices may also be fully or partially implantable.

The present invention is directed to a filter for a microphone system of a miniature electronic device, wherein said filter comprises a sound inlet and a sound outlet, wherein the filter is adapted to be mounted on a surface of a printed circuit board. Therefore, a filter is proposed which can be easily and reliably mounted on one surface of the printed circuit board while the microphone is mounted on the opposite surface of the printed circuit board.

In an embodiment, the filter is adapted to be mounted on the surface of the printed circuit board such that the sound outlet of the filter faces the printed circuit board in a portion thereof which is formed with a through-hole. The filter can be mounted such that the center axis thereof is aligned to the center axis of the through-hole.

In an embodiment, the filter is an acoustical low pass filter or an acoustical band pass filter. Therefore, the provision of an electrical low pass or band pass filter (LPF, BPF) at the output of the microphone can be omitted, while non-linearity can be reduced and efficiency increased without disadvantages. Further, omission of an electrical filter at the output of the microphone allows increased density of the printed circuit board. The surface mounted filter allows to provide a distance between e.g. the membrane of the microphone and the acoustical low pass filter or the acoustical band pass filter provided by the filter itself. This increases efficiency of the filter. Further, losses in sensitivity can be reduced.

In an embodiment, the filter is a SMD component adapted to be machine mounted on the surface of the printed circuit board by means of a pick and place process. The inventive filter allows a fast, secure and precise placing and mounting on the surface of the printed circuit board, providing a reliable and quick interchangeable or adaptable mechanical interface for sound pickup.

In an embodiment, the proposed filter further comprises an acoustic tube for coupling the sound inlet to the sound outlet. Dimensions of the acoustic tube can be defined such to allow best acoustical filter matching or rather demands.

In an embodiment of the proposed filter the acoustic tube is adapted to be mounted on the printed circuit board such that the longitudinal direction of the acoustic tube passes through the through-hole formed into the printed circuit board.

In an embodiment of the proposed filter the acoustic tube comprises a flange adapted to be mounted on a portion of the printed circuit board surrounding the through-hole. The flange allows fast and proper placement and fixation of the filter on the surface of the printed circuit board.

In an embodiment, the filter further comprises a seal including an elastic material, said seal surrounding the acoustic tube in at least a portion of the sound inlet of the filter. The seal can be provided with a hole formed through the seal in a longitudinal direction thereof. The filter can be equipped with the seal by simply fitting the seal via its hole on the acoustic tube. In an example, the filter can be mounted on the surface of the printed circuit board with the seal already pre-assembled to the acoustic tube. In another example, the filter can be mounted on the surface of the printed circuit board with the seal assembled to the acoustic tube in a later processing step, i.e. in a processing step after said mounting step. Since the seal surrounds the acoustic tube in at least a portion of the sound inlet of the filter, acoustic leakage can be prevented. A further benefit of the proposed solution is that the seal allows a radial sealing, which is much more robust than e.g. a face to face sealing.

In an embodiment of the proposed filter the length of the seal, in a direction of the acoustic tube, is dimensioned such to exceed the length of the acoustic tube. The length can be dimensioned such to engage a sound entrance of e.g. the housing of the hearing device in an acoustically sealed manner. Due to the elastic material of the seal, at least the distal end of the seal can engage a sound entrance of e.g. the housing of the hearing device in a snuggle fit connection. Therefore, acoustic leakage can be prevented.

In an embodiment of the proposed filter the acoustic tube is made of plastic. Therefore, costs can be reduced while still exhibiting improved acoustic properties.

In an embodiment of the proposed filter the acoustic tube is mounted on the printed circuit board by means of gluing. In this embodiment, the acoustic tube, which can comprise plastic, can be easily mounted on the surface of the printed circuit board. In an example, the top layer of a multi-layer printed circuit board can be blanked out to create a sink which sink is dimensioned such to receive the flange of the filter. In this example, the diameter of the flange of the filter is the same or less than the diameter of the sink.

In a further embodiment of the proposed filter the acoustic tube is made of a metal.

In an embodiment of the proposed filter the acoustic tube is mounted on the printed circuit board by means of soldering or gluing. In this embodiment, the acoustic tube, which can comprise metal, can be easily mounted on the surface of the printed circuit board by means of soldering or gluing. The soldering can comprise reflow soldering or rather SMD-soldering as can be already used in an automated SMD pick and place process. Advantageously, the filter, via e.g. its acoustic tube, flange, etc., can be soldered directly on the surface of the printed circuit board in a highly precise manner. In order to allow proper positioning, an additional copper-ring can be added to a top layer of the printed circuit board. In an example, the top layer of a multi-layer printed circuit board can be blanked out or rather recessed to create a sink which sink can be provided with an additional copper-ring at its bottom. In this example, the diameter of the flange of the filter is the same or less than the diameter of the sink. If the acoustic tube is made of metal, this metal made acoustic tube can be glued to the printed circuit board or a sink recessed into the printed circuit board, directly.

In an embodiment of the proposed filter the seal is formed tapered. The tapered shape of the seal, optionally in connection with the elastic properties of the seal, allows a snuggle fit connection against the sound entrance of e.g. the housing of the hearing device. The sound entrance of the housing can comprise an acoustic canal opened to the environment.

In an embodiment, the filter further comprises at least one of an acoustical filter element and a protective cover received into at least a portion of the acoustic tube or at a sound entry or a sound exit of the acoustic tube. The acoustical filter element can be configured to compensate a possible reduction in sensitivity. Further, sensitivity for ultra-sonic can be reduced.

In an embodiment of the proposed filter the miniature electronic device is a hearing aid.

In an embodiment of the proposed filter the seal is dimensioned such to provide an acoustically tight coupling between a sound entrance channel of the miniature electronic device and the sound inlet. Hence, acoustic leakage can be prevented. Further, the seal allows a reliable radial sealing against the sound entrance channel.

The invention is further related to a microphone system comprising a printed circuit board, a filter according to one of the preceding claims mounted on a first surface of the printed circuit board, at least one microphone mounted on a second surface of the circuit board, wherein an acoustic input of the microphone is acoustically coupled to the sound outlet of the filter via a through-hole formed into the printed circuit board. The inventive microphone system allows a smaller and easier mechanical design providing reduced costs as well as improved performance and efficiency.

In an embodiment, the microphone system comprises a further microphone and a further filter according to one of claims 1 to 17 mounted on opposing surfaces of the printed surface board, wherein the acoustic input of the further microphone is acoustically coupled to the sound outlet of the further filter via a further through-hole formed into the printed circuit board. In case of the microphone system comprises more than one microphone and associated filter, the microphones can be mounted on one and the same surface of the printed circuit board or on opposing surfaces. The same applies to the associated filters, vice versa.

In an embodiment of the proposed microphone system the microphone is a dynamic microphone, a condenser microphone, an electret condenser microphone or a MEMS microphone. Further still known or forthcoming microphones can be used as well.

The invention is further related to a miniature electronic device comprising a housing formed with at least one sound entrance, a printed circuit board equipped with at least one processing means and a microphone system of one of claims 18 to 20. The sound entrance can be any opening in the housing allowing sound entrance to the interior of the housing. In an example, the opening can be any opening which may be assigned to additional purposes, e.g. technical and/or mechanical purposes. In an example, the opening for allowing sound entrance can be an opening which is exposed adjacent to a shift button. In a further example, the opening can be a pin insertion hole for the purpose of maintenance, etc.

In an embodiment of the proposed miniature electronic device the filter comprises a seal adapted to prevent acoustic leakage. Therefore, the miniature electronic device allows sound entrance from the environment to the acoustic input of the microphone via the filter, directly, without acoustic leakage.

In an embodiment, the proposed miniature electronic device is a hearing aid. Hence, provided is a hearing aid showing reduced non-linearity at the output(s) of the one or more microphone(s) even with the omission of a respective filter.

Moreover, the invention is related to a method of equipping a printed circuit board with a filter according to one of claims 1 to 17, wherein said method comprises the step of mounting the filter to the surface of the printed circuit board by means of a pick and place process. The pick and place process can comprise a process of reflow soldering or gluing of components to the surface of the printed circuit board. The inventive method can allow usage of different MEMS microphones with same mechanical and/or acoustical properties. The pick and place process is a simple, reliable and precise process which further achieves cost savings.

It is expressly pointed out that any combination of the above-mentioned embodiments is subject of further possible embodiments. Only those embodiments are excluded that would result in a contradiction.

BRIEF DESCRIPTION OF THE DRAWINGS

The present invention is further described with reference to the accompanying drawings jointly illustrating various exemplary embodiments which are to be considered in connection with the following detailed description. What is shown in the figures is.

DETAILED DESCRIPTION OF THE INVENTION

Figure 1:
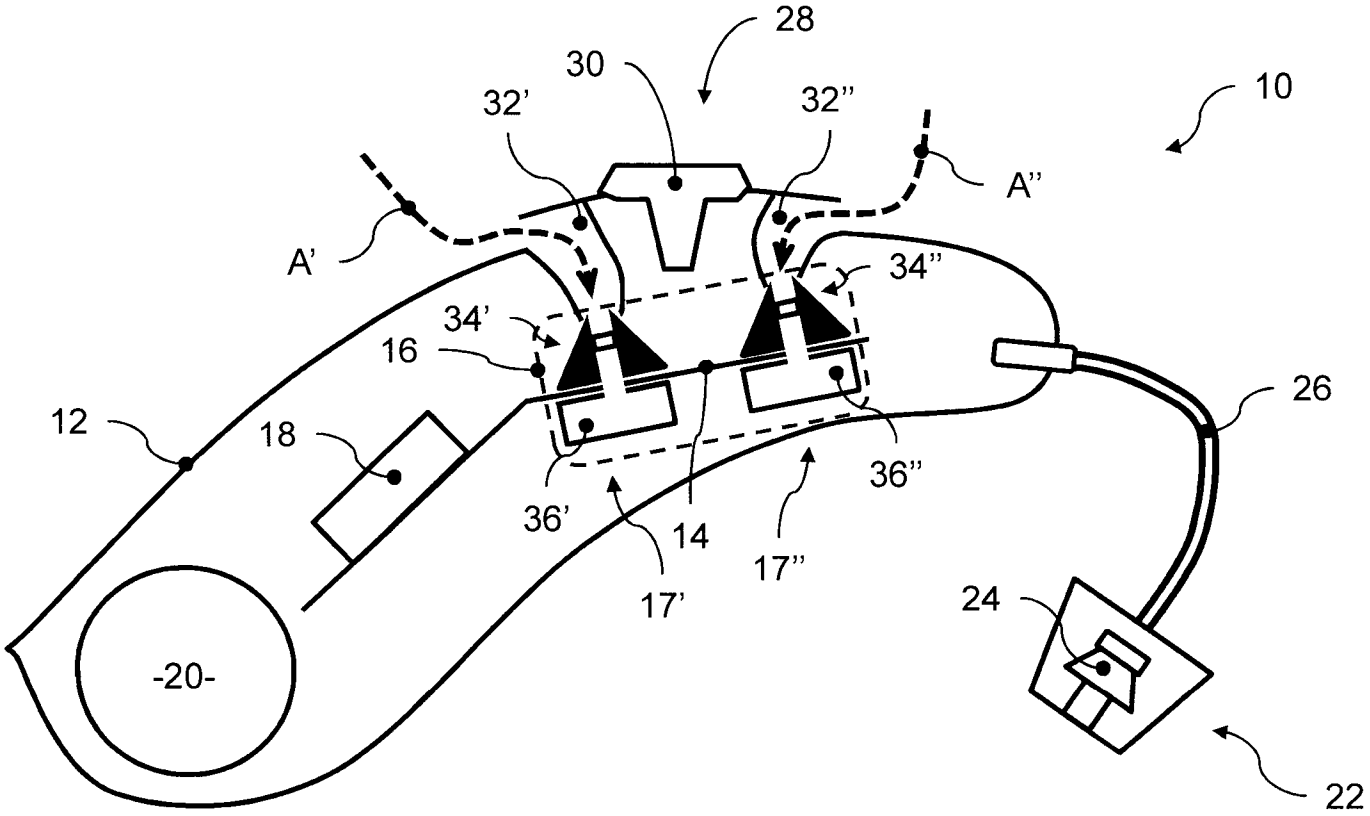
FIG. 1 schematically depicts a cross-sectional view of a hearing aid in an embodiment of the invention.

FIG. 1 is a schematically cross-sectional view of a hearing aid 10. The hearing aid 10 comprises a housing 12 for accommodating a printed circuit board 14 comprised by a microphone system 16 (shown surrounded by a dashed line in the figure). The microphone system 16 further comprises two microphone arrangements 17',17" to be explained in more detail in the following. While the microphone system 16 is shown to comprise two microphone arrangements 17',17", the microphone system 16 can comprise one or more than two microphone arrangements. The printed circuit board 14 can be equipped with a processing means 18. The processing means 18 may be a digital signal processor or an analogue signal processor. While the printed circuit board 14 is shown to be configured integrally, the printed circuit board 14 can comprise more than one board, wherein e.g. one board thereof can be used for supporting one or more microphone arrangements. The hearing device 10 further comprises a battery 20 for suppling electrical power to the hearing aid components, e.g. the processing means 18, the microphone system 16, etc. The hearing aid 10 is further equipped with an ear canal plug 22 to be inserted into the ear of a user. Said plug 22 can comprise a receiver 24 for transmitting sound into the ear canal of the user. The receiver 24 can be connected to receiver means (not shown), which are comprised into the housing 12 of the hearing aid 10, via a connecting line 26 which can be configured as an electrical connection or an acoustical tube.

The hearing aid 10 further comprises an electrical switching means 28 for e.g. switching between different modes of the hearing aid 10, adjusting the loudness, etc. The electrical switching means 28 comprises a control button 30 which can be operated by the user from the outside of the housing 12. In the shown example, the control button 30 is a shifting button which can be shifted up and down in order to e.g. allow the user to shift between different hearing aid menus, to adjust the loudness, etc.

While the control button 30 of the electrical switching means 28 can substantially cover the interior of the housing 12 against the environment, there can be portions between the housing 12 and the control button 30 which are opened to the environment. In an example, portions at a top part and bottom part (on the right and on the left side when viewed in the figure) of the control button 30 can be opened to the environment. These openings allow acoustical sound entrance, e.g. speech, into the interior of the housing 12 as schematically depicted by two dashed arrows A',A". In the interior of the housing 12, the sound which enters into the housing 12 via the above-mentioned openings can be guided by means of two sound entrance channels 32',32". Said sound entrance channels 32',32" can comprise wall portions comprised by e.g. the housing 12 and/or the electrical switching means 28.

As mentioned above, in the shown example, the microphone system 16 comprises two microphone arrangements 17',17". The microphone arrangements 17',17" can comprise filters 34',34" and microphones 36',36", respectively. The filters 34',34" each comprise a seal formed tapered, to be described in more detail in the following. The filters 34',34" are mounted on a first surface of the printed circuit board 14, while the microphones 36',36" are mounted on a second surface of the printed circuit board 14, respectively. The first and second surfaces of the printed circuit board 14 are opposed to each other. The printed circuit board 14, in portions thereof which are sandwiched between the filters 34',34" and the microphones 36',36", respectively, is formed with through-holes to be described in more detail in the following.

The filters 34',34" provided on the first surface of the printed circuit board 14 each comprise a sound inlet and a sound outlet, wherein the filters 34',34" are mounted such that the sound inlets are exposed to the sound entrance channels 32',32" for picking up sound, while the sound outlets face the printed circuit board 14 in a portion thereof which is formed with the through-holes. On the other hand, the microphones 36',36" provided on the second surface of the printed circuit board 14 are mounted such that respective acoustic inputs of the microphones 36',36" face the printed circuit board 14 in a portion thereof which is formed with the through-holes. Therefore, sound picked up from the environment can be coupled to the acoustic inputs of the respective microphones 36',36" via the filters 34',34" and the through-holes.

Thus, the filters 34',34" and microphones 36',36" are stacked to each other, respectively, with the printed circuit board 14 interposed, while sound transmission is achieved via the through-holes. This arrangement allows that space of the printed circuit board 14, volume of the interior of the housing 12, etc. can be exploited more efficiently. The sound can be passed through filter components (to be described in the following) comprised by the filters 34',34". Said filter components can comprise an acoustical filter element and/or protective cover for filtering out dust, dirt, foreign particles, etc., and therefore preventing entrance thereof into the microphones 36',36".

The tapered shape of the seals allows to provide an acoustically tight coupling to the sound entrance channels 32',32". In other words, each sound entrance channel 32',32" by its distal end snugly engages the surface of the respective seal in an acoustically sealed manner. Due to the elastic properties of the seals, this sealing can be further enhanced. In an example, the acoustically sealed coupling can be established during fitting of a first shell portion (e.g. a half-shell) to a second shell portion (e.g. a counterpart of the half-shell) of the housing 12. The first shell portion can be provided with one or both sound entrance channels 32',32" or can be a part thereof.

While FIG. 1 shows both filters 34',34" mounted on one and the same surface of the printed circuit board 14 (e.g. the first surface) with the microphones 36',36" mounted on the opposite surface (e.g. the second surface), this arrangement can be inverted. In other words, the filters 34',34" can be mounted on opposite surfaces of the printed circuit board 14, respectively, with the microphones 36',36" respectively mounted on opposite surfaces of the printed circuit board 14, vice versa. This arrangement allows to pick up sound arriving from opposite sides of the hearing device 10 (e.g. left/right, front/rear, etc.). Therefore, intelligibility can be improved.

Figure 2:
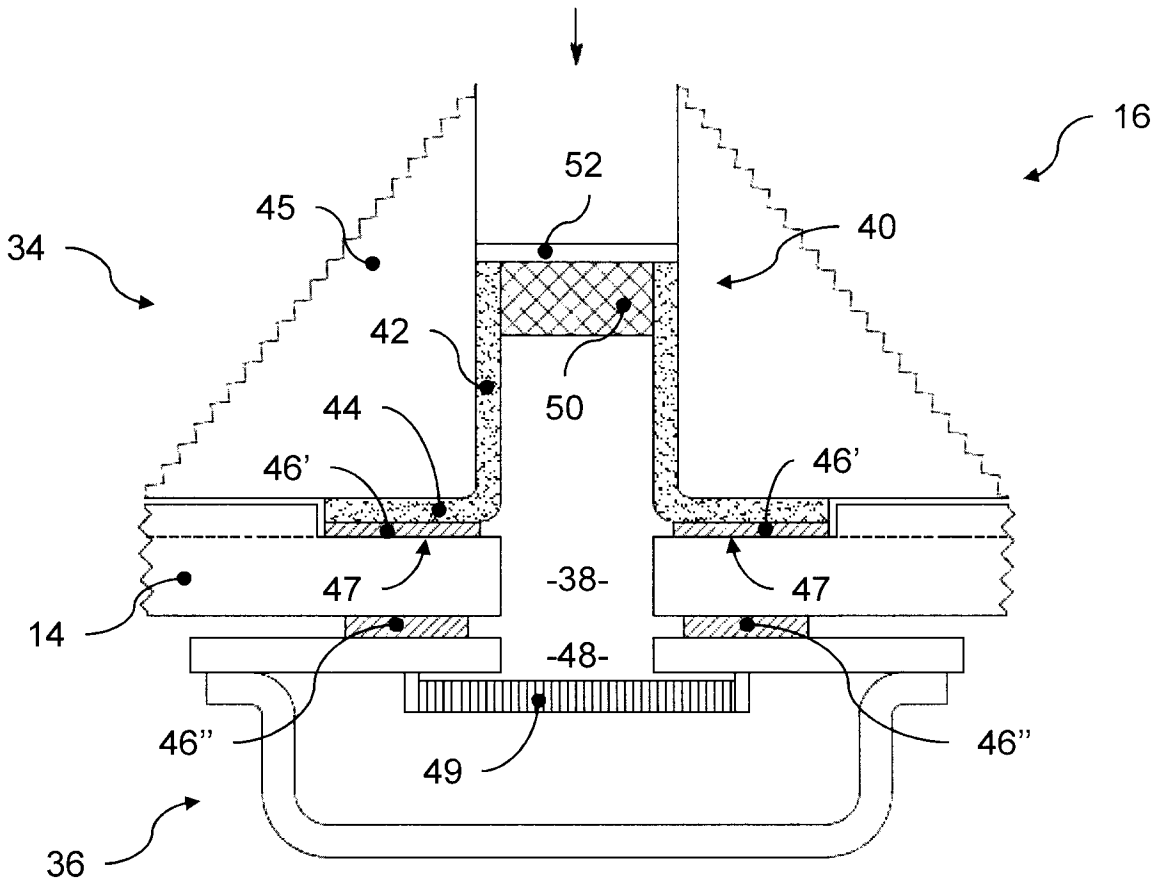
FIG. 2 schematically depicts a cross-sectional view of a microphone system in an embodiment of the invention.

FIG. 2 shows a microphone system 16 in an enlarged view. In the FIG. 2, components which are same or similar to components as shown and described having regard to FIG. 1, are referenced with same or similar reference signs. The microphone system 16 comprises a filter 34 and microphone 36 which are mounted on opposite surfaces of the printed circuit board 14, with the printed circuit board 14, which is provided with the through-hole 38, interposed. In an example, the filter 34 can be an acoustical low pass filter or an acoustical band pass filter. Therefore, provision of an electrical filter can be omitted without suffering acoustically disadvantages, e.g. increased non-linearity, etc.

The filter 34 can be configured as a SMD component filter. Therefore, the SMD component filter can be precisely mounted on surfaces of the printed circuit board 14 by means of a pick and place process. The filter 34 comprises a filter element 40 provided within an acoustic tube 42. The acoustic tube 42 in turn can be mounted on the printed circuit board 14 by means of a flange 44 thereof, which flange 44 surrounds the acoustic tube 42 at a bottom end thereof. The filter 34 further comprises a seal 45 which surrounds the acoustic tube 42. The seal 45 can be formed tapered, wherein the seal 45 is mounted on the acoustic tube 42 such that the cone tapers at the end pointing to the top. The seal 45 can be made of an elastic material, for example rubber. The centre axis of the conically shaped seal 45 can be provided with a passage which is formed such to engage the acoustic tube 42 by simply attaching the seal 45 to the acoustic tube 42 from the above. Due to the elasticity of the material of the seal 45, the acoustic tube 42 and the seal 45 can be fixed to each other simply by frictional forces. Therefore, fixing means, such as e.g. glue, can be omitted.

As mentioned above, the filter 34 is connected to a surface of the printed circuit board 14 by means of the acoustic tube 42, in particular by means of the flange 44 of the acoustic tube 42. In doing so, the acoustic tube 42 can be mounted on the surface of the printed circuit board 14 by means of a first bonding 46', which can comprise solder (i.e. solidified solder) or glue. In an example, assuming the acoustic tube 42 is made of plastic, the acoustic tube 42 is mounted on the surface of the printed circuit board 14 by means of gluing. On the other hand, assuming the acoustic tube 42 is made of a metal, the acoustic tube 42 is mounted on the surface of the printed circuit board 14 by means of soldering or gluing. If the acoustic tube 42 is mounted on the surface of the printed circuit board 14 by means of soldering, an additional copper-ring (not shown) can be provided on the surface of the printed circuit board 14. In an example, the surface of the printed circuit board 14 can be recessed to create a sink 47, wherein the sink 47 can receive the first bonding 46' (solder or glue). In case of soldering, the sink 47 can comprise an additional copper-ring at its bottom (not-shown). The diameter of the flange 44 can be the same or less than the diameter of the sink 47.

A portion of the surface of the printed circuit board 14 opposing the filter 34 is equipped with the microphone 36. The microphone 36 can be mounted on the surface of the printed circuit board 14 by means of a second bonding 46", which can comprise (solidified) solder or glue. The first 46' and second 46" bonding can be the same, i.e. both comprising (solidified) solder or glue, or can be different from each other. The filter 34 and the microphone 36 can be mounted on the respective surfaces of the printed circuit board 14 such that the centre axis of the acoustic tube 42 of the filter 34 and the centre axis of an acoustic input 48 of the microphone 36 both pass through the through-hole 38. In an example, both axes are substantially aligned to each other. In a further example, both axes run along one and the same line. The microphone 36, at the acoustic input 48 thereof, is provided with a back plate 49 which is provided with a plurality of holes. Incoming sound pressure waves passing through the holes in the back plate 49 can cause a diaphragm (not shown) comprised by the microphone 36 to move in proportion to the amplitude of compression and rarefaction waves. This movement varies the distance between the diaphragm and the back plate 49, which in turn varies the capacitance. This capacitance variance in turn can be converted into an electrical signal.

The above-mentioned filter element 40 can comprise an acoustical filter element 50 disposed inside the acoustic tube 42. The acoustical filter element 50 can be adapted to reduce non-linearity and/or sensitivity for ultra-sonic, etc. In the acoustic tube 42, the distance between the acoustical filter element 50 and the back plate 49 can be adjusted such to optimize filter characteristics of the filter 34. Since the acoustical filter element 50 can be clogged due to contamination, e.g. dust, dirt, foreign particles, etc., a protective cover 52 can be provided for preventing entrance of contaminations. The protective cover 52 is provided upstream of the acoustical filter element 50, when view in direction of sound entrance as indicated by an arrow. The protective cover 52 can be designed as a washable or easily replicable inlet filter.

What is claimed is:

1. A filter (34;34',34") for a microphone system (16) of a miniature electronic device (10), said filter (34;34',34") having a sound inlet and a sound outlet, an acoustic tube (42) for coupling the sound inlet to the sound outlet, wherein the filter (34;34',34") is adapted to be mounted on a surface of a printed circuit board (14) such that the sound outlet of the filter (34,34',34") faces the printed circuit board (14) in a portion thereof which is formed with a through-hole (38); and wherein the acoustic tube (42) is adapted to be mounted on the printed circuit board (14) such that the longitudinal direction of the acoustic tube (42) passes through the through-hole (38) formed into the printed circuit board (14).

2. The filter (34;34',34") according to claim 1, wherein the filter (34;34',34") is an acoustical low pass filter or an acoustical band pass filter.

3. The filter (34;34',34") according to claim 1, wherein the filter (34;34',34") is a SMD component adapted to be machine mounted on the surface of the printed circuit board (14) by means of a pick and place process.

4. The filter (34) according to claim 1, wherein the acoustic tube (42) comprises a flange (44) adapted to be mounted on a portion of the printed circuit board (14) surrounding the through-hole (38).

5. The filter (34) according to claim 1, further comprising a seal (45) including an elastic material, said seal (45) surrounding the acoustic tube (42) in at least a portion of the sound inlet of the filter (34).

6. The filter (34) according to claim 5, wherein the length of the seal (45), in a direction of the acoustic tube (42), is dimensioned such to exceed the length of the acoustic tube (42).

7. The filter (34) according to claim 5, wherein the seal (45) is formed tapered.

8. The filter (34) according to claim 5, wherein the seal (45) is dimensioned such to provide an acoustically tight coupling between a sound entrance channel (32',32") of the miniature electronic device (10) and the sound inlet.

9. The filter (34) according to claim 1, wherein the acoustic tube (42) is made of plastic.

10. The filter (34) according to claim 9, wherein the acoustic tube (42) is mounted on the printed circuit board (14) by means of gluing.

11. The filter (34) according to claim 1, wherein the acoustic tube (42) is made of a metal.

12. The filter (34) according to claim 11, wherein the acoustic tube (42) is mounted on the printed circuit board (14) by means of soldering or gluing.

13. The filter (34) according to claim 1, further comprising at least one of an acoustical filter element (50) and a protective cover (52) received into at least a portion of the acoustic tube (42) or at a sound entry or a sound exit of the acoustic tube.

14. The filter (34;34',34") according to claim 1, wherein the miniature electronic device is a hearing aid (10).

15. A microphone system (16) comprising a printed circuit board (14), a filter (34') according to claim 1 mounted on a first surface of the printed circuit board (14), at least one microphone (36') mounted on a second surface of the printed circuit board (14), wherein an acoustic input of the microphone (36') is acoustically coupled to the sound outlet of the filter (34') via a through-hole formed into the printed circuit board (14).

16. The microphone system (16) according to claim 15, wherein the microphone system (16) comprises a further microphone (36") and a further filter (34") having a sound inlet and a sound outlet, wherein the filter and the further filter are mounted on opposing surfaces of the printed circuit board (14), wherein the acoustic input of the further microphone (36") is acoustically coupled to the sound outlet of the further filter (34") via a further through-hole formed into the printed circuit board (14).

17. The microphone system (16) according to claim 15, wherein the microphone (36;36',36") is a dynamic microphone, a condenser microphone, an electret condenser microphone or a MEMS microphone.

18. A miniature electronic device (10) comprising a housing (12) formed with at least one sound entrance, a printed circuit board (14) equipped with at least one processing means (18) and a microphone system (16) of claim 15.

19. The miniature electronic device (10) according to claim 18, wherein the filter (34;34',34") comprises a seal (45) adapted to prevent acoustic leakage.

20. The miniature electronic device (10) according claim 18, wherein the miniature electronic device is a hearing aid (10).

21. A method of equipping a printed circuit board (14) with a filter (34;34',34") according to claim 1, said method comprising the step of mounting the filter (34;34',34") to the surface of the printed circuit board (14) by means of a pick and place process.

* * * * *